US005213954A

United States Patent [19]

Shor et al.

[11] Patent Number: 5,213,954

[45] Date of Patent: May 25, 1993

[54] WHITE LIGHT HANDLEABLE NEGATIVE-ACTING SILVER HALIDE PHOTOGRAPHIC ELEMENTS

[75] Inventors: Steven M. Shor, Maplewood, Minn.; Keven P. Hall, Sawbridgeworth, United Kingdom

[73] Assignee: Minnesota Mining and Manufacturing Company, St. Paul, Minn.

[21] Appl. No.: 615,080

[22] Filed: Nov. 19, 1990

Related U.S. Application Data

[63] Continuation of Ser. No. 386,631, Jul. 31, 1989, abandoned.

[51] Int. Cl.[5] ..... G05C 1/915

[52] U.S. Cl. ..... 430/512; 430/513; 430/931

[58] Field of Search ..... 430/512, 513, 931

[56] References Cited

U.S. PATENT DOCUMENTS

| | | | |
|---|---|---|---|
| Re. 30,303 | 6/1980 | Weber, II et al. | 430/512 |
| 2,050,588 | 8/1936 | Schneider | 430/513 |
| 2,112,226 | 3/1938 | Baldsiefen et al | 430/513 |
| 4,045,229 | 8/1977 | Weber, II et al. | 96/84 |
| 4,307,183 | 12/1981 | Delfino | 430/495 |
| 4,307,184 | 12/1981 | Beretta et al. | 430/512 |
| 4,311,787 | 1/1982 | Lemahieu et al. | 430/513 |
| 4,576,908 | 3/1986 | Vallarino | 430/512 |
| 4,849,326 | 7/1989 | Besio et al. | 430/512 |
| 4,946,768 | 8/1990 | Vallarino | 430/512 |

OTHER PUBLICATIONS

Defensive Publication No. T972001 (U.S. Ser. No. 05/762,356 filed Jan. 25, 1977) Weber, II et al.

*Primary Examiner*—Jack P. Brammer

*Attorney, Agent, or Firm*—Gary L. Griswold; Walter N. Kirn; Mark A. Litman

[57] ABSTRACT

UV-sensitive negative acting silver halide photographic elements are used in contacting processes, and especially dry etch correction processes and can be safely handled under white light. These elements comprise a support base, a negative acting hydrophilic colloidal silver halide emulsion layer comprising photographic silver halide grains, and one or more hydrophilic colloidal layers, wherein said silver halide emulsion support base has on its surface most distant from the layer an antihalation layer comprising a water-removable UV-absorbing compound having significant absorption in the range of from 350 to 400 nm.

10 Claims, No Drawings

WHITE LIGHT HANDLEABLE NEGATIVE-ACTING SILVER HALIDE PHOTOGRAPHIC ELEMENTS

This is a continuation of application Ser. No. 07/386,631 filed Jul. 31, 1989, now abandoned.

FIELD OF THE INVENTION

The present invention relates to UV sensitive negative acting silver halide photographic elements, and more particularly to UV sensitive negative acting silver halide photographic elements which can be handled under room lighting conditions without significant loss in image density, and which upon development of a half-tone image thereon can be dry etched with improved performance characteristics.

BACKGROUND OF THE ART

Light sensitive recording materials may suffer from a phenomenon known as halation which causes degradation in the quality of the recorded image. Such degradation may occur when a fraction of the imaging light which strikes the photosensitive layer is not absorbed but passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element may cause light passing through the element to be scattered. Scattered light which is reflected from the film base will, on its second passage through the photosensitive layer, cause exposure over an area adjacent to the point of intended exposure. It is this effect which leads to image degradation. Silver halide based photograhic materials (including photothermographic materials) are prone to this form of image degradation since the photosensitive layers contain light scattering particles. The effect of light scatter on image quality is well documented and is described, for example, in T. H. James "The Theory of the Photographic Process", 4th Edition, Chapter 20, Macmillan 1977.

It is common practice to minimise the effects of light scatter by including a light absorbing layer within the photographic element. To be effective the absorption of this layer must be at the same wavelengths as the sensitivity of the photosensitive layer. In the case of imaging materials coated on transparent base, a light absorbing layer is frequently coated on the reverse side of the base from the photosensitive layer. Such a coating, known as an "antihalation layer", effectively prevents reflection of any light which has passed through the photosensitive layer.

A similar effect may be achieved by a light absorbing layer interposed between the photosensitive layer and the base. This construction, described as an "antihalation underlayer" is applicable to photosensitive coatings on transparent or non-transparent bases. A light absorbing substance may be incorporated into the photosensitive layer itself, in order to absorb scattered light. Substances used for this purpose are known as "acutance dyes". It is also possible to improve image quality by coating a light absorbing layer above the photosensitive layer of a wet processed photographic element. Coatings of this kind, described in U.S. Pat. Specification No. 4,312,941 prevent multiple reflections of scattered light between the internal surfaces of a photographic element.

When the wavelength of sensitivity of the imaging medium is within the visible regions of the electromagnetic spectrum it is often necessary to have the antihalation dye rendered colorless prior to viewing of the final image. If the dye is not rendered colorless, the visible antihalation dye will provide a background density or stain to the final image. Antihalation dyes can be rendered colorless by way of heat bleaching, development solution bleaching, a specific bleaching solution, or removal from the medium in a dissolving bath.

When the wavelength of sensitivity of the medium, and hence the wavelength of absorption of the antihalation dye, is outside the visible region, it is not necessary to decolorize the antihalation dye since it has no color (i.e., it is not visible). Some antihalation dyes may have absorption tails that extend into the visible region and would therefore have to be decolorized (e.g., U.S. Pat. No. 4,581,325).

It is very desirable to produce silver halide photographic elements for duplicating and contacting processes which may be handled safely in bright white light. The benefits of this include ease of working and inspection of the element during exposure and processing, and generally more pleasant working conditions for the operators. Negative acting silver halide elements can generally be made resistant to fogging in room light by making use of an accentuated low intensity reciprocity failure effect.

In the use of negative acting ultraviolet radiation sensitive photographic silver halide emulsions and elements, it is desirable to have the elements room light or white light handlable. Providing these emulsions and elements with ultraviolet radiation sensitivity below 400nm can provide an element with good room light handlability. These elements, primarily useful as black and white image forming elements, can still benefit from and often need backside antihalation layers in order to provide sharp images. Using UV absorbing antihalation dyes without any significant tail in the visible region of the electromagnetic spectrum has eliminated the need for decolorizing of the antihalation dye.

It has been discovered by applicants, however, that when half-tone images produced from such UV sensitive photographic media are used in dry etch processes, there is an adverse affect on the process from the residual antihalation dye. In the dry etch process, the photosensitive medium of this invention is repeatedly exposed through the black-and-white half-tone color separation image. These multiple exposures increase the dot sizes, minimizing on-press dot gain or correcting color balance or tone. If the UV dye is not present in the antihalation layer of the unexposed UV sensitive film, what is ordinarily observed is that the higher percentage dots expand to fill in the highlights (veiling) before there is sufficient dot gain in the low percentage and intermediate dots. Conversely if the UV dye is still present in the imaged medium after processing then subsequent exposures to duplicating, proofing or plate materials necessitates higher exposure to burn through the high UV Dmin areas which causes a shift in dot size, leading to inaccurate dot reproduction.

Thus two key requirements are 1) that the UV dye be present during the image step of the unimaged material for optimal dry etching, and 2) that the UV dye be removed during the chemical process for optimal subsequent contact exposures.

U.S. Reissue Pat. No. 30,303 describes UV absorbing dyes useful as filter dyes in photographic elements. The claims are for molecules of the type

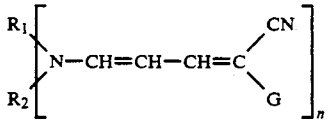

wherein n is 1 or 2, when n is 1, $R_1$ and $R_2$ are independently chosen to represent hydrogen, an alkyl group of 1 to 10 carbon atoms, or a cyclic alkyl group of 5 or 6 carbon atoms provided that $R_1$ and $R_2$ cannot both be hydrogen, or $R_1$ and $R_2$ taken together represent the atoms necessary to complete a cyclic amino group and when n is 2 at least one of $R_1$ and $R_2$ is alkylene and G represents an electron withdrawing group. They are incorporated in a photographic element of a suport, silver halide layer(s) and in UV filter layer containing above dye. Alternatively, they can be in the film support. The examples given refer to color negative coatings, though black and white constructions are not excluded. No mention is made of water solubilization or bleachability. Their use is to protect the film of unwanted UV exposure to give a more balanced color rendition.

Similar abilities are described in U.S. Pat. Nos. 4,307,184 and 4,756,908. The first patent refers to polymeric versions of the dye class and is fairly far removed from our proposed use. The second patent refers to particular versions of Formula I ($R_1$-$R^2$-allyl for 3, and R short chain alkyl, $C_1$-$C^3$ $R_1$=opt. subs long chain alkyl $>C_{10}$ ). Advantages are claimed for improved absorption profiles, easier and more consistent dispersions obtainable and show a reduced speed loss compared to the derivatives claimed in Reissue Pat. No. 30,303. Again the main application is for the UV filter dye in the color negative constructions The dyes are hydrophobic in U.S. Pat. Nos. 4,307,184 and 4,576,908 and presumably would not be bleached in processing. In fact it is usually preferred to be nonbleachable and nondiffusing to give UV protection after processing. In U.S. Pat. No. 4,307,183 the supersensitizing combination of a polymeric version of Formula I with a methine spectral sensitizer in silver halide constructions is claimed.

Of more relevance is U.S. patent application Ser. No. [F/381] where water solubilized versions of I are claimed in direct positive (black and white) silver halide constructions. A general formula of water solubilization is used which may make it novel compared to the class and uses disclosed in Reissue Patent 30,303. The dye has to be reactively associated with the silver halide emulsion and is not disclosed specifically as a backside coating. Advantages are claimed for improved white light safety with minimal residual UV stain after processing.

SUMMARY OF THE INVENTION

According to the present invention, there is provided a UV sensitive negative acting silver halide photographic element for contacting processes which can be safely handled under white light, said element comprising a support, a hydrophilic colloidal silver halide emulsion layer comprising negative acting silver halide grains, and a backside coated antihalation layer, wherein said backside coated antihalation layer comprises a water removable UV absorbing compound having at least 80% absorption in the range of 350 to 400 nm.

DETAILED DESCRIPTION OF THE INVENTION

The present invention relates to a UV sensitive negative acting silver halide photographic element comprising a support, a hydrophilic colloidal silver halide emulsion layer comprising negative acting UV sensitive photographic silver halide grains, and at least a backside coated UV absorbing antihalation layer, wherein said antihalation layer comprises a water removable UV absorbing compound having at least 80% of absorption in the range of 350 to 400 nm.

Preferably, the UV absorbing compounds for use in the silver halide photographic element according to the present invention correspond to the general formula:

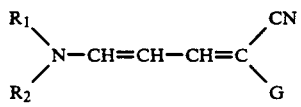

I in which:

$R_1$ and $R_2$, the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$, $R_2$ and G is substituted with a water solubilizing group.

In the above general formula (I):

$R_1$ and $R_2$ can be the same or different and represent alkyl groups, preferably alkyl groups having 1 to 10 carbon atoms, more preferably alkyl groups having 1 to 4 carbon atoms, including substituted alkyl groups such as cyanoalkyl or alkoxyalkyl groups, aryl groups, preferably aryl groups having 6 to 20 carbon atoms, more preferably aryl groups having 6 to 10 carbon atoms or cyclic alkyl groups, preferably cyclic alkyl groups having 5 or 6 carbon atoms or $R_1$ and $R_2$ taken together represent the elements necessary to complete a cyclic amino group such as, for example, a piperidino, a morpholino, a pyrrolidino, a hexahydroazepino and a piperazino group, G represents an electron withdrawing group of any electron withdrawing groups known in the art such as, for example, CN, $NO_2$, COOR or $SO_2R$ wherein R represents an alkyl group, preferably an alkyl group having 1 to 10 carbon atoms, more preferably an alkyl group having 1 to 4 carbon atoms, or an aryl group (such as phenyl or naphthyl), preferably an aryl group having 6 to 20 carbon atoms, more preferably an aryl group having 6 to 10 carbon atoms, and at least one of $R_1$, $R_2$ and G is substituted with a water solubilizing group of any water solubilizing groups known in the art such as, for example, a COOH group or an alkaline metal or ammonium salt thereof, a $SO_3H$ group or an alkaline metal or ammonium salt thereof, a hydroxy group, a quaternary ammonium salt containing group, a phosphate group or a polyoxyalkylene group.

More preferably, the UV absorbing compounds for use in the silver halide photographic elements according to the present invention correspond to the general formula:

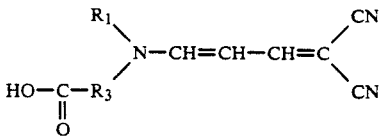

II in which:

$R_1$ represents an alkyl group having 1 to 10 carbon atoms, preferably a lower alkyl group having 1 to 4 carbon atoms such as, for example, methyl, ethyl, propyl, isopropyl, butyl, isobutyl or tert-butyl group, and $R_3$ represents an alkylene group having 1 to 10 carbon atoms whose carbon atom chain may comprise divalent groups such as, for example, —O—, —S—, —COO—or —$SO_2$—.

The UV absorbing compounds of the photographic elements according to the present invention have a strong absorption in the region of the electromagnetic spectrum at the boundary between the UV and the visible region. The UV absorbing compounds according to this invention have a peak or plateau in its absorbing spectrum around 380 nm. At least 80% of their absorption is in the range of from 350 to 400 nm, their absorption below 350 nm being such as not to affect significantly the response of the silver halide emulsion to the UV radiation of the exposure light, preferably such as not to absorb more than 30% of the radiation emitted by exposure lamps having a maximum emulsion wavelength of 317nm. Additionally, the UV absorbing compounds of the photographic elements according to the present invention are highly soluble in water, so that they can be washed out of the element during processing, without a significant retention of UV absorption. Preferably, the absorption of the element in $D_{min}$ areas after processing is, in the range from 300 nm to 400 nm, less than 0.10.

The following are examples of water soluble UV absorbing compounds which are applicable to the present invention:

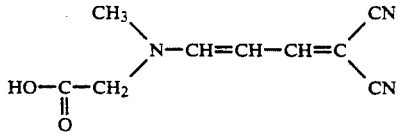

(1)

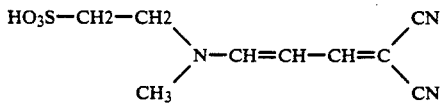

(2)

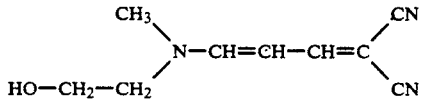

(3)

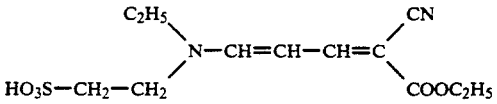

(4)

-continued

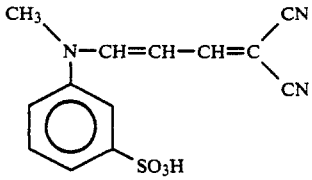

(5)

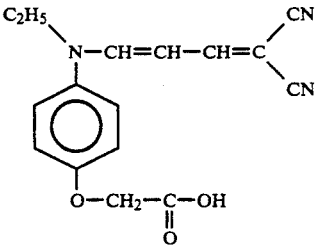

(6)

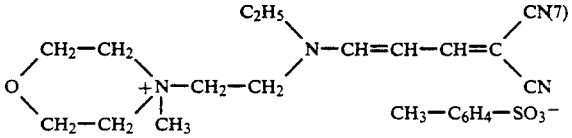

(7)

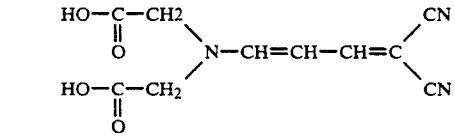

(8)

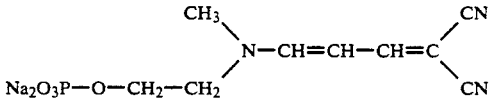

(9)

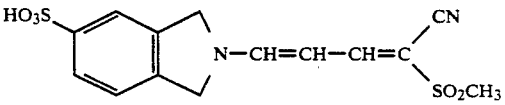

(10)

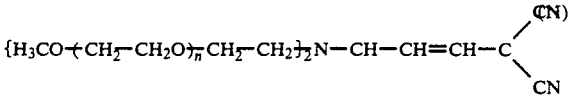

(wherein n = 12–14)

The UV absorbing compounds of this invention can be prepared according to methods well known in the art. The UV absorbing compounds of general formulas (I) and (II) can be prepared by treating an appropriate amine compound containing the water solubilizing group with an appropriate intermediate in an organic solvent at boiling temperature followed by usual techniques for isolating the compounds. Useful intermediates are for example described in U.S. Pat. No. 4,045,229.

The following is a preparative example of a UV absorbing compound for use in the present invention.

PREPARATIVE EXAMPLE

Compound (1)

N-(3-allylidenemalononitrile)-sarcosine

Sarcosine (89.1 grams, 1 mole) was dissolved in 170 ml of water containing NaOH (40 grams, 1 mole) and 450 ml of methanol. Acetanilidoallylidenemalononitrile (216 grams, 0.91 moles) was then added with stirring. The mixture was refluxed for 30 minutes and then cooled in ice. The addition of 100 ml of 37% HCl separated a yellow colored solid that was filtered and crystallized from a 2:1 ethanol-water mixture. The obtained product (112 grams, yield 65%) had a M.P.=170°-2° C. and a percent analysis for $C_9H_9N_3O$ as follows:

| | N% | C% | H% |
|---|---|---|---|
| Calculated | 21.98 | 56.54 | 4.74 |
| Found | 21.66 | 56.22 | 4.72 |

Spectrophometric analysis :
λmax(in water)=374nm
ε(in water)=52,000
The product is soluble in water upon addition of a stoichiometric quantity of NaOH.

In the photographic elements of this invention, the UV absorbing compounds are used in an aqueous penetrable binder layer hydrophilic colloidal layer on the backside of the base or support layer. Said backside layer is further from the exposure light source than the silver halide emulsion layer and on the opposite side of the base from the silver halide emulsion layer. In order to incorporate the UV absorbing compounds into an hydrophilic colloidal layer of the silver halide photographic elements according to this invention, they may be added in the form of a water solution to the hydrophilic colloidal coating composition. The amount of the UV absorbing compounds used, although different according to the type of the compound or of silver halide emulsion to be used, is generally about 0.02g/m$^2$ or greater (preferably no more than 0.3g/m$^2$). The antihalation dye should provide an absorbance between 350 and 400 nm (e.g., 375 nm) of at least 0.3, preferably at least 0.5, and more preferably at least 0.8.

It is well known in the art that silver halides have a high natural sensitivity to UV radiations and that silver bromide also has a relatively high sensitivity to blue and shorter wavelength visible light, while silver chloride has a relatively low sensitivity to blue and to shorter wavelength visible light. Therefore, silver halide emulsions for use in the photographic elements according to this invention are preferably higher chloride silver halide emulsions. They preferably contain at least 50% mole and more preferably at least 75% mole of silver chloride. The higher the silver chloride content, the lower is the natural blue and visible light sensitivity, even if the UV radiation sensitivity remains high. More preferably, the silver halide emulsions to be used in type photographic elements according to the present invention are emulsions wherein at least 75% by weight of all silver halide grains are silver halide grains wherein at least at 80% mole is silver chloride. The remaining silver halide, if any, will be silver bromide and/or silver iodide but the latter should normally be present in an amount not exceeding 10% mole. In case of silver halides comprising chloride in the range of from 50 to 75% mole, the remaining halide being essentially bromide, the spectral sensitivity is even more extended to visible region and it may be useful to combine the UV absorbing compounds according to this invention with dyes capable of absorbing visible radiations so that the photographic element can be safely handled in bright light conditions. The dyes include, for example, oxonol dyes, benzylidene dyes, and the like, which can be bleachable or washable during processing. Examples of useful dyes are described, for example, in U.S. Pat. No. 4,140,531. In conventional emulsions sensitizing dyes are used to extend the sensitivity of the emulsion to longer wavelengths of visible light. This is not required with the emulsions used in the present invention. It also appears to be desirable for the high chloride silver halide emulsions to have a relatively small grain size, e.g. a mean grain size of from 0.05 to 0.6 micron, the preferred grain size being in the range of from 0.05 to 0.3 microns and the most preferred being from 0.05 to 0.1 micron. The high chloride silver halide grains preferably have a cubic shape, but may have other shapes, such as octahedra, spheres, tabular shapes, etc.

In the present invention, silver halides are preferably prepared in the presence of at least a doping metallic element of the 8th Group of the Periodic Table of Elements, such as rhodium, iridium and ruthenium, which acts as electron acceptor. Said doping element is preferably chosen among water-soluble iridium salts, water-soluble ruthenium salts, or water-soluble rhodium salts. Iridium salts include iridium and alkaline metal halides, such as potassium iridium (III) hexachloride and sodium iridium (III) hexabromide. Rhodium salts include rhodium halides, such as rhodium (III) trichloride and rhodium (IV) tetrachloride and rhodium and alkaline metal halides such as potassium rhodium (III) hexabromide and sodium rhodium (III) hexachloride. These salts may be added in a quantity of from $0.5\times10^{-4}$ to $10\times10^{-4}$ moles, and preferably from $2\times10^{-4}$ to $7\times10^{-4}$ moles per mole of silver halide.

Gold compounds, used for chemical sensitization, include alkali metal chloroaurates, chloroauric acid, gold sulfide, gold selenide, and the like. Said gold compounds are generally used in a quantity of from $1\times10^{-6}$ to $1\times10^{-4}$ moles per mole of silver halide.

The UV sensitive silver halide emulsions of the photographic elements according to this invention may contain various other photographic additives wich include sensitizers, desensitizers, solarization accelerators, stabilizers, hardeners, coating aids, preservatives, matting agents, antistatic agents, and the like, as described, for example, in U.S. Pat. No. 4,495,274.

Gelatin is generally used as hydrophilic colloid for the silver halide photographic elements of the present invention. As hydrophilic colloids, gelatin derivatives, natural substances such as albumin, casein, agar-agar, alginic acid and the like, and hydrophilic polymers such as polyvinyl alcohol, polyvinylpyrolidone, cellulose ethers, partially hydrolized polyvinyl acetate, and the like can be used in addition to or instead of gelatin. Further, gelatin can be partially substituted with polymer latexes obtained by emulsion polymerization of vinyl monomers, such as polyethylacrylate latexes, to improve the physical characteristics of the photographic layers.

Support bases used in the negative-acting silver halide photographic elements according to this invention can be any of the conventionally used support bases, such as glass, cloth, metal, film including for example cellulose acetate, cellulose acetate-butyrate, cellulose nitrate, polyester, polyamine, polystyrene, and the like, paper including baryta-coated paper, resin-coated paper, and the like.

The silver halide photographic elements according to this invention may be used in the field of Graphic Arts for various purposes, such as, for example, for contacting, for reproduction, for making offset printing masters, as well as in radiography for special purposes, in electron photography, and the like, where high UV sensitivity is required together with low blue light sensitivity.

The silver halide photographic elements according to this invention are highly UV sensitive and give high contrast and low minimum density (fog) when they are exposed with light rich in UV rays, and they can be handled in bright white room light.

These and other advantages according to the present invention will be illustrated with reference to the following examples.

EXAMPLE 1

A silver halide emulsion containing 84 mole % chloride and 16 mole % bromide was prepared by adding simultaneously and under stirring, over a period of 25 minutes, with a double-jet technique, water solution B and water solution C to water gelatin solution A, said water solutions having the composition reported herein below.

Solution A

Water - g 833.3
Gelatin - g 25
Polyvinylpyrrolidone (K−30)−6.33
KBr - ml 0.167 (1N)

Solution B

Water - g 368
$AgNO_3$ - g 170

Solution C

Water - g 361.3
KCl - g 62.65 (0.84 moles)
KBr - g 19.04 (0.16 moles)
$Na_3RhCl_6.12H_2O$ - g 0.200

The gelatin solution was kept at constant temperature of 30° C. The addition rate of solution B was constant, while the addition rate of solution C varied such as to maintain the millivolt of the emulsion thus formed at a value of 120±2 mv measured with a specific electrode for Br ion and a reference electrode of the saturated Ag/AgCl type. The emulsion, wherein the soluble salts had been removed with the conventional coagulation method, had a mean grain diameter of 0.09 μm. The emulsion was then chemically sensitized with sodium thiosulfate and sodium gold chloride. At the end of the chemical sensitization a triazole stabilizer was added and the emulsion was prepared for coating with the addition of additional gelatin, coating surface active agents and formaldehyde hardener.

The emulsion was then coated at a silver coating weight of 2.7g $Ag/m^2$ onto a polyethylene terephthalate support base which was backed with green antihalation layers that had varying amounts of yellow, blue and UV dye as shown as explained in Table 1 and FIGS. 1 and 2.

The resulting films were exposed through a 0–2, 20 cm continuus wedge. The exposing lamp was a violux 1500S UV lamp at a distance of 52 inches from the film plane.

The exposed films were developed in 3M RDC developer for 20 sec at 40° C. and fixed in 3M fix roll fixer.

Dmin, Dmax, Speed at 0.2, Toe Contrast, and Average Contrast of the resulting coatings show that the E-E sensitivity are essentially the same.

Next the dry etching characteristics were examined which demonstrates the resulting improvement by incorporating the UV dye into the antihalation formulation.

In order to evaluate the dry etching characteristics it is first necessary to determine the optimum dot-for-dot exposure in the E-E mode.

For these tests a hard dot original was used. The optimum contact exposure which we will define as producing a Dmax>4.0 with a dot reproduction within 1% at the midtone turned out to be 18 units.

The dry etch test then consists of making contact exposures to the original of 1×, 2×, 4×, 6×, 8×, 10×, 12×, 14× and 16× the dot-for-dot exposure. The resulting dot enlargement is measured. Both the highlight, shadow and midtone are of importance with the objective being to obtain a very controlled movement of all dot sizes and as large a movement as possible in the midtone and shadow before the highlights veil in.

TABLE 1

Antihalation Characteristics of the Various Coatings

| Coating No. | Absorbance *B | *Y | *UV |
|---|---|---|---|
| 1 | .83 | .34 | .18 |
| 2 | .80 | .34 | .38 |
| 3 | .80 | .33 | .50 |
| 4 | .80 | .48 | 0.24 |
| 5 | .82 | .49 | .69 |

*B is oxonol blue 628 which has an absorbance peak at 650 nm
*Y is oxonol yellow K which has an absorbance peak at 430 nm
*UV is the water soluble UV dye number 1 of this invention which has an absorbance peak at 370 nm

TABLE 2

Sensitometry of the Various Coatings

| Ctg. No. | Dmin | Dmax | S.2 | Toe Contrast | Average Contrast |
|---|---|---|---|---|---|
| 1 | .04 | 4.5 | −2.86 | 2.09 | 9.8 |
| 2 | .04 | 4.5 | −2.87 | 2.14 | 9.8 |
| 3 | .04 | 4.5 | −2.87 | 2.20 | 9.6 |
| 4 | .04 | 4.5 | −2.86 | 2.17 | 9.4 |
| 5 | .04 | 4.5 | −2.88 | 2.17 | 9.2 |

TABLE 3

Dry Etch Results

Table 3 shows how dramatically the addition of the UV dye to the antihalation backing affects the resulting dry etching characteristics. It holds back veiling in the highlights allowing greater movement in the midtone and shadow ends.

TABLE 3

Dry Etch Results

| Exposure | Original Target | Coating 1 10% | Coating 1 50% | Coating 1 91% | Coating 2 10% Invention | Coating 2 50% Invention | Coating 2 91% Invention | Coating 3 10% Invention | Coating 3 50% Invention | Coating 3 91% Invention | Coating 4 10% | Coating 4 50% | Coating 4 91% | Coating 5 10% Invention | Coating 5 50% Invention | Coating 5 91% Invention |
|---|---|---|---|---|---|---|---|---|---|---|---|---|---|---|---|---|
| | Resulting contact dot | | | | | | | | | | | | | | | |
| 18 Units | | 91 | 51 | 9 | 91 | 51 | 9 | 91 | 51 | 9 | 91 | 51 | 9 | 91 | 51 | 9 |
| 2X | | 93 | 54 | 10 | 92 | 53 | 10 | 92 | 53 | 9 | 92 | 53 | 10 | 92 | 53 | 10 |

TABLE 3-continued

| | | Dry Etch Results | | | | | | | | | | | | | | |
|---|---|---|---|---|---|---|---|---|---|---|---|---|---|---|---|---|
| | | | | | Coating 2 | | | Coating 3 | | | | | | Coating 5 | | |
| | Original | Coating 1 | | | 10% | 50% | 91% | 10% | 50% | 91% | Coating 4 | | | 10% | 50% | 91% |
| Exposure | Target | 10% | 50% | 91% | Invention | | | Invention | | | 10% | 50% | 91% | Invention | | |
| 4X | | 96 | 58 | 11 | 94 | 57 | 11 | 94 | 57 | 10 | 94 | 57 | 11 | 93 | 56 | 11 |
| 6X | veiling | 99 | 63 | 12 | 95 | 60 | 12 | 95 | 59 | 11 | 97 | 60 | 12 | 94 | 59 | 11 |
| 8X | | | | | 97 | 62 | 12 | 96 | 61 | 12 | 99 | 63 | 13 | 95 | 60 | 12 |
| 10X | | | veiling | | 99 | 64 | 13 | 97 | 63 | 12 | | | | 96 | 61 | 12 |
| 12X | | | | | | | | 98 | 64 | 13 | | | | 97 | 63 | 13 |
| 14X | | | | | | | | 98 | 65 | 13 | | | | 97 | 64 | 13 |
| 16X | | | | | | veiling | | 99 | 66 | 14 | | | | 98 | 65 | 14 |

We claim:

1. A UV sensitive silver halide photographic element comprising a support, a hydrophilic colloidal silver halide emulsion layer comprising UV sensitive negative acting silver halide grains on one side of said support, and a backside coated antihalation layer on the other side of said support, said antihalation layer comprising a water soluble UV absorbing compound having at least 80% radiation absorption in the wavelength range of 350 to 400 nm, said compound being capable of being washed out of said antihalation layer during photographic processing, wherein said UV absorbing compound is represented by the general formula:

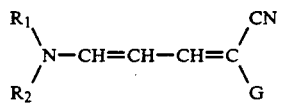

(I)

in which:

$R_1$ and $R_2$, the same or different, each represents an alkyl group, an aryl group, or a cyclic alkyl group, or $R_1$ and $R_2$ taken together represent the atoms necessary to complete a cyclic amino group, G represents an electron withdrawing group, and at least one of $R_1$, $R_2$, and G is substituted with a water solubilizing group.

2. The silver halide photographic element of claim 1, wherein the added quantity of said water removable UV absorbing compound is in the range greater than 0.02 g/m$^2$ such that the absorbance in the coated element is greater than 0.3.

3. The silver halide photographic element of claim 1, wherein said UV absorbing compound is comprised in a hydrophilic colloid layer.

4. The silver halide photographic element of claim 1, wherein said silver halide emulsion is a high chloride silver halide emulsion.

5. The silver halide photographic element of claim 2, wherein said silver halide grains have been prepared in the presence of a water soluble iridium salt or a water soluble rhodium salt.

6. A UV sensitive silver halide photographic element comprising a support, a hydrophilic colloidal silver halide emulsion layer comprising UV sensitive negative acting silver halide grains on one side of said support, and a backside coated antihalation layer on the other side of said support, said antihalation layer comprising a water soluble UV absorbing compound having at least 80% radiation absorption in the wavelength range of 350 to 400 nm, said compound being capable of being washed out of said antihalation layer during photographic processing, wherein said UV absorbing compound is represented by the general formula:

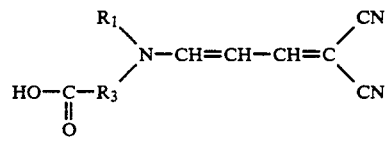

(II)

in which:

$R_1$ represents an alkyl group, and $R_3$ represents an alkylene group.

7. The silver halide photographic element of claim 6, wherein the added quantity of said water removable UV absorbing compound is in the range greater than 0.02 g/m$^2$ such that the absorbance in the coated element is greater than 0.3.

8. The silver halide photographic element of claim 6, wherein said UV absorbing compound is comprised in a hydrophilic colloid layer.

9. The silver halide photographic element of claim 6, wherein said silver halide emulsion is a high chloride silver halide emulsion.

10. The silver halide photographic element of claim 7, wherein said silver halide grains have been prepared in the presence of a water soluble iridium salt or a water soluble rhodium salt.

* * * * *

UNITED STATES PATENT AND TRADEMARK OFFICE

CERTIFICATE OF CORRECTION

PATENT NO. : 5,213,954

DATED : May 25, 1993

INVENTOR(S) : Shor et al.

It is certified that error appears in the above-identified patent and that said Letters Patent is hereby corrected as shown below:

Col. 3, line 39 after "constructions", add -- . --

Col. 6, line 43 "CH—C" should be -- CH=C --

Col. 6, line 43

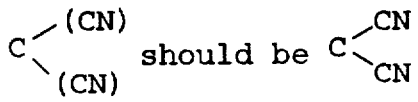

Col. 6, line 43 after formula, add -- (11) --

Signed and Sealed this

Twelfth Day of July, 1994

Bruce Lehman

*Attest:*

BRUCE LEHMAN

*Attesting Officer*

*Commissioner of Patents and Trademarks*